US012161165B2

(12) United States Patent
Saygili

(10) Patent No.: US 12,161,165 B2
(45) Date of Patent: Dec. 10, 2024

(54) AEROSOL-GENERATING SYSTEM AND CARTRIDGE WITH LEAKAGE PROTECTION

(71) Applicant: Philip Morris Products S.A., Neuchatel (CH)

(72) Inventor: Ali Murat Saygili, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 663 days.

(21) Appl. No.: 17/299,883

(22) PCT Filed: Dec. 6, 2019

(86) PCT No.: PCT/EP2019/084042
§ 371 (c)(1),
(2) Date: Jun. 4, 2021

(87) PCT Pub. No.: WO2020/115306
PCT Pub. Date: Jun. 11, 2020

(65) Prior Publication Data

US 2022/0022544 A1 Jan. 27, 2022

(30) Foreign Application Priority Data

Dec. 7, 2018 (EP) ..... 18211161

(51) Int. Cl.
*A24F 40/485* (2020.01)
*A24F 40/42* (2020.01)
*A24F 40/46* (2020.01)

(52) U.S. Cl.
CPC ..... *A24F 40/485* (2020.01); *A24F 40/42* (2020.01); *A24F 40/46* (2020.01)

(58) Field of Classification Search
CPC ..... A24F 40/485; A24F 40/46; A24F 40/42
(Continued)

(56) References Cited

U.S. PATENT DOCUMENTS 2,838,200 A 6/1958 Brewer
3,098,506 A 7/1963 Spragens
(Continued)

FOREIGN PATENT DOCUMENTS

CN 107920585 A * 4/2018 ..... A24D 1/04
CN 108685177 A * 10/2018 ..... A24F 47/008
(Continued)

OTHER PUBLICATIONS

Combined Russian Office Action and Search Report issued Mar. 23, 2023 in Russian Patent Application No. 2021118680/03 (with English Translation), 16 pages.
(Continued)

*Primary Examiner* — Peter G Leigh
(74) *Attorney, Agent, or Firm* — Oblon, McClelland, Maier & Neustadt, L.L.P.

(57) ABSTRACT

A system is provided, including: a first component including a first fluidic channel, a first airflow passage, and a reservoir holding an aerosol-generating substrate, the first fluidic channel being fluidically coupled to the reservoir; a second component including a second fluidic channel and a second airflow passage; a joint rotatably coupling the first component to the second component, and rotation, via the joint, of the first component and the second component from a first angle to a second angle relative to one another couples the first fluidic channel to the second fluidic channel and couples the first airflow passage to the second airflow passage; and a breakable member coupled to the first component and the second component, the rotation of the first component and the second component relative to one another breaks the breakable member.

14 Claims, 10 Drawing Sheets

(58) Field of Classification Search
USPC ..... 131/329
See application file for complete search history.

(56) References Cited

U.S. PATENT DOCUMENTS

| | | | | |
|---|---|---|---|---|
| 5,769,073 | A * | 6/1998 | Eason | A61M 15/0048 128/200.22 |
| 9,848,650 | B2 * | 12/2017 | Li | A24F 40/485 |
| 9,894,937 | B2 * | 2/2018 | Li | H05B 3/0014 |
| 9,943,654 | B2 * | 4/2018 | Herrmann | A61M 11/02 |
| 10,064,433 | B2 * | 9/2018 | Li | H05B 3/0014 |
| 2004/0261807 | A1 * | 12/2004 | Dube | A24D 3/14 131/331 |
| 2005/0016533 | A1 * | 1/2005 | Schuler | A61M 15/0051 128/203.15 |
| 2013/0206136 | A1 | 8/2013 | Herrmann et al. | |
| 2014/0353856 | A1 | 12/2014 | Dubief | |
| 2015/0238723 | A1 | 8/2015 | Knudsen | |
| 2016/0249683 | A1 | 9/2016 | Li et al. | |
| 2017/0254425 | A1 | 9/2017 | Takamatsu et al. | |
| 2018/0028993 | A1 | 2/2018 | Dubief | |

FOREIGN PATENT DOCUMENTS

| | | | | |
|---|---|---|---|---|
| JP | 60-33891 | U | 3/1985 | |
| JP | 2018-16380 | A | 2/2018 | |
| JP | 2018-504132 | A | 2/2018 | |
| JP | 2018-527918 | A | 9/2018 | |
| JP | 6404418 | B2 * | 10/2018 | A24B 15/16 |
| KR | 101710120 | B1 * | 2/2017 | A24D 1/008 |
| KZ | 31601 | B | 9/2016 | |
| RU | 2 627 004 | C2 | 8/2017 | |
| RU | 2 643 421 | C2 | 2/2018 | |
| RU | 2 672 650 | C2 | 11/2018 | |
| WO | WO-2013017624 | A1 * | 2/2013 | A24D 3/0216 |
| WO | WO 2013/083636 | A1 | 6/2013 | |
| WO | WO 2015/070402 | A1 | 5/2015 | |
| WO | WO 2015/117702 | A1 | 8/2015 | |
| WO | WO 2016/096733 | A1 | 6/2016 | |
| WO | WO 2017/085452 | A1 | 5/2017 | |
| WO | WO-2017129617 | A1 * | 8/2017 | A24B 15/167 |
| WO | WO-2018050612 | A1 * | 3/2018 | A24B 15/167 |
| WO | WO-2018050613 | A1 * | 3/2018 | A24B 15/167 |
| WO | WO 2018/077363 | A1 | 5/2018 | |

OTHER PUBLICATIONS

Combined Chinese Office Action and Search Report issued Nov. 7, 2023 in Chinese Patent Application No. 201980075051.1 (with English Translation), 10 pages.

International Search Report and Written Opinion issued on Mar. 19, 2020 in PCT/EP2019/084042 filed on Dec. 6, 2019.

Written Opinion of the International Preliminary Examining Authority issued on Dec. 15, 2020 in PCT/EP2019/084042 filed on Dec. 6, 2019.

Extended European Search Report Issued Jul. 31, 2019 in European Patent Application No. 18211161.7, 9 pages.

International Preliminary Report on Patentability and Written Opinion issued Mar. 15, 2021 in PCT/EP2019/084042, 13 pages.

Japanese Office Action issued Nov. 6, 2023 in Japanese Patent Application No. 2021-528953 (with English Translation), 5 pages.

* cited by examiner

AEROSOL-GENERATING SYSTEM AND CARTRIDGE WITH LEAKAGE PROTECTION

The invention relates to aerosol-generating systems and in particular aerosol-generating systems that produce an aerosol for inhalation by a user.

One type of aerosol-generating system is an electrically heated smoking system that generates an aerosol for a user to inhale. Electrically heated smoking systems come in various forms. One popular type of electrically heated smoking system is an e-cigarette that vapourises a liquid aerosol-forming substrate, or other condensed form of aerosol-forming substrate, to generate an aerosol.

WO2015/117702A describes an aerosol-generating system that heats a liquid substrate to form an aerosol. The heating is accomplished using a mesh of heating filaments. The liquid is conveyed to the mesh from a liquid reservoir by a capillary material on one side of the mesh. An airflow channel is on the other side of the mesh. Vaporised liquid aerosol-forming substrate passes through the mesh into the airflow channel. The mesh, together with the capillary material, is used to prevent the passage of liquid droplets into the airflow channel.

However, in some circumstances the liquid substrate may condense or leak, and as a result may enter into and potentially be sucked through the airflow channel. This may result in a diminished experience for the user.

In a first aspect herein, there is provided a system, comprising:

- a first component comprising a first fluidic channel and a first airflow passage;
- a second component comprising a second fluidic channel and a second airflow passage; and
- a joint rotatably coupling the first component to the second component. Advantageously, rotation, via the joint, of the first component and the second component from a first angle to a second angle relative to one another couples the first fluidic channel to the second fluidic channel and couples the first airflow passage to the second airflow passage.

Optionally, the system further comprises a breakable member coupled to the first component and the second component, wherein rotation of the first component and the second component relative to one another breaks the breakable member.

Additionally, or alternatively, optionally the first component further comprises a first air inlet and a first air outlet, the first airflow passage extending therebetween, and a reservoir holding an aerosol-generating substrate, the first fluidic channel being fluidically coupled to the reservoir. Additionally, or alternatively, optionally the second component further comprises a second air inlet and a second air outlet, the second airflow passage extending therebetween, and an aerosol-generating element coupled to the second fluidic channel. Advantageously, coupling of the first fluidic channel to the second fluidic channel couples the second air outlet to the first air inlet so as to form an extended airflow passage between the second air inlet and the first air outlet, and coupling of the first fluidic channel to the second fluidic channel allows aerosol-generating substrate from the reservoir to be in fluidic communication with the aerosol-generating element via the first and second fluidic channels to generate an aerosol which is transmitted into the extended airflow passage.

As a further option, rotation, via the joint, of the first component and the second component from the second angle to the first angle relative to one another decouples the second air outlet from the first air inlet so as to inhibit airflow between the second air inlet and the first air outlet, and decouples the first fluidic channel from the second fluidic channel so as to inhibit fluidic communication between the aerosol-generating element and the reservoir.

Additionally, or alternatively, optionally the aerosol-generating element comprises a heating element. Additionally, or alternatively, optionally the heating element is liquid-permeable. Additionally, or alternatively, the heating element comprises a mesh. Optionally, the mesh is formed from wire having a diameter between about 10 μm and 100 μm. Additionally, or alternatively, optionally the aerosol-generating substrate comprises nicotine. Additionally, or alternatively, optionally the second component comprises an internal housing holding the aerosol-generating element. Additionally, or alternatively, optionally the second component further comprises a chamber, one side of the aerosol-generating element being in fluidic communication with the second fluidic channel and an opposite side of the aerosol-generating element being in fluidic communication with the chamber. Optionally, the second component further comprises a gas-permeable element. As a further option, one side of the gas-permeable element is in fluidic communication with the chamber and an opposite side of the gas-permeable element is in fluidic communication with the second airflow passage. As a still further option, the internal housing further comprises a lid, the gas-permeable element being disposed between the lid and the aerosol-generating element.

Additionally, or alternatively, optionally the first angle is about 180° from the second angle.

Additionally, or alternatively, optionally the system further comprises a device portion comprising a power supply and control circuitry connected to the power supply, the device portion being coupled to the second component.

In another aspect herein, there is provided a method comprising:

- providing a first component comprising a first fluidic channel and a first airflow passage;
- providing a second component comprising a second fluidic channel and a second airflow passage;
- providing a joint rotatably coupling the first component to the second component; and
- rotating, via the joint, the first component and the second component from a first angle to a second angle relative to one another so as to couple the first fluidic channel to the second fluidic channel and to couple the first airflow passage to the second airflow passage.

The present systems and methods may include any suitable combination of optional features and configurations. For example, where a gas-permeable element is provided, optionally, it may comprise a mesh. The mesh may advantageously be formed from a corrosion resistant material, such as stainless steel. The mesh may be coated with a material that increases the hydrophobicity or oleophobicity of the mesh. For example, nano-coatings of silicon carbide, silicon oxide, fluoropolymers, titanium oxide or aluminium oxide may be applied to the mesh, or to filaments prior to formation of a mesh from the filaments, by liquid phase deposition, vapour phase deposition or thermal plasma evaporation.

Where the gas-permeable element comprises a mesh formed from a plurality of filaments, the filaments may be arranged in a square weave so that the angle between filaments that contact one another is approximately 90°. However, other angles between filaments that contact one another may be used. Preferably the angle between filaments that contact one another is between 30° and 90°. The plurality of filaments may comprise a woven or non-woven fabric.

The aerosol-generating system may comprise a reservoir (substrate chamber) for holding the aerosol-forming substrate. The aerosol-forming substrate may be a liquid at room temperature. In that case the reservoir may be described as a liquid reservoir. The aerosol-forming substrate may be in another condensed form, such as a solid at room temperature, or may be in another condensed form, such as a gel, at room temperature, or may be in another condensed form, such as a liquid, at room temperature. The aerosol-generating element may be provided, at least in part, between the reservoir and the airflow passage.

The aerosol-generating element may comprise a heating element. Heating the aerosol-forming substrate may release volatile compounds from the aerosol-forming substrate as a vapour. The vapour may then cool within an airflow (such as within the extended airflow passage) to form an aerosol.

The heating element may be configured to operate by resistive heating. In other words, the heating element may be configured to generate heat when an electrical current is passed though the heating element.

The heating element may be configured to operate by inductive heating. In other words, the heating element may comprise a susceptor that, in operation, is heated by eddy currents induced in the susceptor. Hysteresis losses may also contribute to the inductive heating.

The heating element may be arranged to heat the aerosol-forming substrate by conduction. The heating element may be in fluidic communication, e.g., direct or indirect contact, with the aerosol-forming substrate. For example, the heating element may be in fluidic communication, e.g., in direct or indirect contact, with the reservoir. The heating element may be arranged to heat the aerosol-forming substrate by convection. In particular, the heating element may be configured to heat a flow of air that subsequently passes through, or by, the aerosol-forming substrate.

The heating element may be liquid permeable (fluid permeable). In particular, the heating element may permit vapour from the aerosol-forming substrate to pass through the heating element and into the extended airflow passage. The heating element may be positioned between the reservoir and the extended airflow passage, or between a channel coupled to the reservoir and the extended airflow passage, or between one or more transport media (such as a capillary material) and the extended airflow passage. The heating element may separate the reservoir from the extended airflow passage, or may separate the channel from the extended airflow passage, or may separate said one or more transport media from the extended airflow passage. One side of the heating element may be in fluidic communication, e.g., direct or indirect contact, with the aerosol-generating substrate (aerosol forming substrate) and an opposite side of the heating element may be in fluidic communication, e.g., direct or indirect contact, with the extended airflow passage.

In some embodiments, the heating element is a generally planar, fluid permeable heating element, such as a mesh, perforated plate or perforated foil.

The heating element may comprise a mesh formed from a plurality of electrically conductive filaments. The electrically conductive filaments may define interstices between the filaments and the interstices may have a width of between 10 μm and 100 μm. Preferably the filaments give rise to capillary action in the interstices, so that in use, liquid aerosol-forming substrate to be vapourised is drawn into the interstices, increasing the contact area between the heater assembly and the liquid.

The electrically conductive filaments may form a mesh of size between 160 and 600 Mesh US (+/−10%) (i.e. between 160 and 600 filaments per inch (+/−10%)). The width of the interstices is preferably between 75 μm and 25 μm. The percentage of open area of the mesh, which is the ration of the area of the interstices to the total area of the mesh is preferably between 25 and 56%. The mesh may be formed using different types of weave or lattice structures. Alternatively, the electrically conductive filaments consist of an array of filaments arranged parallel to one another.

The electrically conductive filaments may have a diameter of between 8 μm and 100 μm, preferably between 8 μm and 50 μm, and more preferably between 8 μm and 39 μm.

The area of the mesh, array or fabric of electrically conductive filaments may be small, preferably less than or equal to 25 $mm^2$, allowing it to be incorporated in to a handheld system. The mesh, array or fabric of electrically conductive filaments may, for example, be rectangular and have dimensions of 5 mm by 2 mm.

The electrically conductive filaments may comprise any suitable electrically conductive material. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation. The filaments may be coated with one or more insulators. Preferred materials for the electrically conductive filaments are 304, 316, 304L, and 316L stainless steel, and graphite.

The electrical resistance of the mesh, array or fabric of electrically conductive filaments of the heater element is preferably between 0.3 and 4 Ohms. More preferably, the electrical resistance of the mesh, array or fabric of electrically conductive filaments is between 0.5 and 3 Ohms, and more preferably about 1 Ohm.

The system may comprise electrical contacts fixed to the heating element. Electrical current may be passed to and from the heating element through the electrical contacts, for example from a device portion to which the first component and/or second component can be releasably coupled. The electrical resistance of the mesh, array or fabric of electrically conductive filaments is preferably at least an order of magnitude, and more preferably at least two orders of magnitude, greater than the electrical resistance of the electrical contacts. This ensures that heat is generated by the heating element and not by the electrical contacts.

The aerosol-generating element may atomise the aerosol-forming substrate by a method other than heating. For example, the aerosol-generating element may comprise a vibrating membrane or may force the aerosol-forming substrate through a fine mesh.

The reservoir (aerosol-forming substrate chamber) may comprise, or may be coupled to, a capillary material or other liquid retention material configured to ensure a supply of aerosol-forming substrate to the heating element or other aerosol-generating element.

The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid to the heater or other aerosol-generating element. Alternatively, the capillary material may comprise sponge-like or foam-like material. The structure of the capillary material forms a plurality of small bores or tubes, through which the liquid can be transported by capillary action. The capillary material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic.

The capillary material may be in fluidic communication, e.g., direct or indirect contact, with the electrically conductive filaments of the heating element. The capillary material may extend into interstices between the filaments. The heating element may draw liquid aerosol-forming substrate into the interstices by capillary action.

The first component and/or the second component independently may contain one or more capillary materials, or may contain two or more different capillary materials (two or more transport media). As one option, a first capillary material, in contact with the heating element, has a higher thermal decomposition temperature and a second capillary material, in contact with the first capillary material but not in contact with the heating element has a lower thermal decomposition temperature. The first capillary material effectively acts as a spacer separating the heating element from the second capillary material, so that the second capillary material is not exposed to temperatures above its thermal decomposition temperature. As used herein, "thermal decomposition temperature" means the temperature at which a material begins to decompose and lose mass by generation of gaseous by products. The second capillary material may advantageously occupy a greater volume than the first capillary material and may hold more aerosol-forming substrate that the first capillary material. The second capillary material may have superior wicking performance to the first capillary material. The second capillary material may be a less expensive or have a higher filling capability than the first capillary material. The second capillary material may be polypropylene.

The aerosol-generating system may comprise an internal housing part holding the heater. The internal housing part may be received in an external housing part. The first and/or second components of the presently disclosed systems may comprise or form any suitable combination of features of the internal housing part and external housing part. The external housing part may include a mouthpiece on which a user puffs to draw air through the extended airflow passage, e.g., from the first air inlet to the second air outlet. The gas-permeable element, if provided, may be positioned on the internal housing part. Optionally, the gas-permeable element may be positioned between a chamber (which may be provided between the reservoir and the heater) and the second airflow channel. The gas-permeable element may separate the chamber from the airflow channel. One side of the gas-permeable element may be in fluidic communication, e.g., direct or indirect contact, with the chamber and an opposite side of the gas-permeable element may be in fluidic communication, e.g., direct or indirect contact, with the airflow passage. The gas-permeable element may be fixed to the internal housing part by clamping. For example, the gas-permeable element may be clamped between two housing portions. The gas-permeable element may be fixed to the internal housing part by overmoulding. In other words a portion of the internal housing part may be moulded around the gas-permeable element.

The aerosol-generating system may have one or more external housing parts, and indeed may include two or more external housing parts, or three or more external housing parts. The external housing part(s) may be configured to be held by a user in a single hand, and may be joined to one another. The external housing part(s) may be formed from a plastics material or from a metal, or any other suitable material or combination of materials.

The aerosol-generating system may be refillable with aerosol forming substrate. The aerosol-forming substrate may be a liquid at room temperature. The aerosol-forming substrate may be a gel or may be solid at room temperature. The aerosol-forming substrate may be provided in the form or a capsule or tablet, or may be provided in a particulate form.

The aerosol-forming substrate is or includes a substrate capable of releasing volatile compounds that can form an aerosol. The volatile compounds may be released by heating the aerosol-forming substrate.

The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material. The aerosol-forming substrate may comprise homogenised tobacco material. The aerosol-forming substrate may comprise at least one aerosol-former. An aerosol-former is any suitable known compound or mixture of compounds that, in use, facilitates formation of a dense and stable aerosol and that is substantially resistant to thermal degradation at the operating temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The aerosol-forming substrate may comprise other additives and ingredients, such as flavourants and water.

The system may further comprise electric circuitry connected to the aerosol-generating element, such as a heater element, and to an electrical power source. The electric circuitry can, for example, be configured to monitor the electrical resistance of the heating element or of one or more filaments of the heating element, and to control the supply of power to the heating element from the power source dependent on the electrical resistance of the heating element or specifically the electrical resistance of the one or more filaments. Optionally, the electric circuitry and the electrical power source can be disposed within a device portion to which the first component and/or second component can be releasably coupled.

The electric circuitry may comprise a microprocessor, which may be a programmable microprocessor, a microcontroller, or an application specific integrated chip (ASIC) or other electronic circuitry capable of providing control. The electric circuitry may comprise further electronic components. The electric circuitry may be configured to regulate a supply of power to the heating element or other aerosol-generating component. Power may be supplied to the heating element continuously following activation of the system or may be supplied intermittently, such as on a puff by puff basis. The power may be supplied to the heating element in the form of pulses of electrical current.

The system may be an electrically operated smoking system. The system may be a handheld aerosol-generating system. The aerosol-generating system may have a size comparable to a conventional cigar or cigarette. The smoking system may have a total length between approximately 30 mm and approximately 150 mm. The smoking system may have an external diameter between approximately 5 mm and approximately 30 mm.

The system advantageously comprises a power supply, typically a battery such as a lithium iron phosphate battery, within the main body of the first component and/or second component or within a device portion that may be coupled to the main body of the first component and/or second component. As an alternative, the power supply may be another form of charge storage device such as a capacitor. The power supply may require recharging and may have a capacity that allows for the storage of enough energy for one or more smoking experiences. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater.

The aerosol-generating system may comprise a cartridge and a device portion, the cartridge being coupled to the device portion in use. The cartridge may comprise the first and second components, the aerosol-forming substrate, and the heating element or other aerosol-generating element. The device portion may comprise a power supply and control circuitry connected to the power supply. The device portion is coupled to the cartridge to allow for a supply of power from the power supply to the aerosol-generating element.

The cartridge may comprise the second air outlet. The cartridge may comprise the reservoir holding the aerosol-generating substrate in condensed form. The cartridge may comprise the liquid-permeable heating element. The cartridge may comprise the gas-permeable element, if provided. The cartridge may comprise the chamber, if provided. The cartridge may comprise the internal housing part and the external housing part, which can be provided as any suitable combination of features of the first and/or second components. The device portion may comprise a device housing that engages with the internal housing part or the external housing part, or both. The airflow passage may extend through the cartridge and the device portion or may extend through only the cartridge portion.

The electrical contacts may be in the cartridge and may engage with corresponding electrical contacts on the device portion.

The configurations provided herein provide a number of advantages. In particular the present configurations can reduce liquid leakage from an aerosol-generating system or from a cartridge in an aerosol-generating system. The provision of a joint that provides coupling and decoupling of fluidic channels to one another and that provides coupling and decoupling of airflow passages to one another advantageously inhibits leakage of aerosol-generating substrate in a condensed form into the airflow passage or out of the device. The presently disclosed subject matter also provides a system that is robust and simple to manufacture.

Embodiments of the invention will now be described, by way of example only, with reference to the accompanying drawings, in which.

Figure 3B:
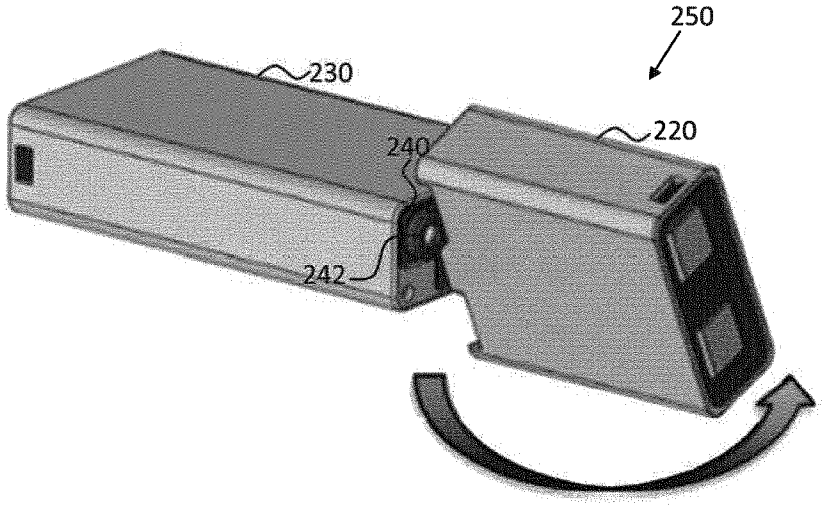
FIG. 3B is a perspective view of the cartridge of FIG. 3A during rotation to a second position.
Figure 3A:
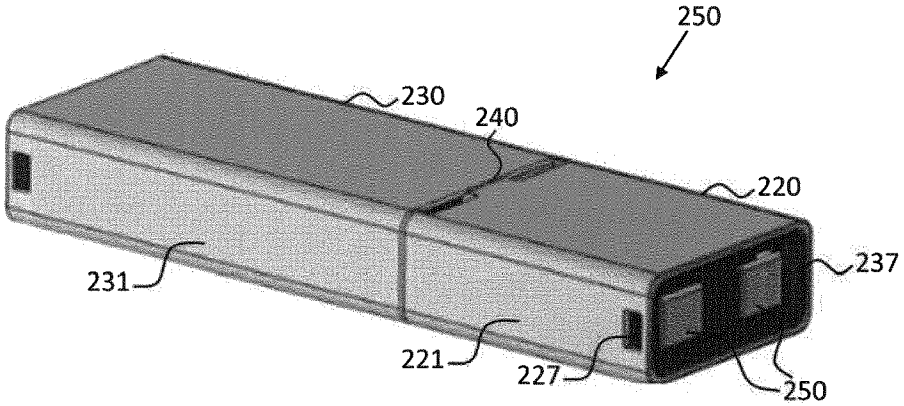
FIG. 3A is a perspective view of a cartridge in a first position, in accordance with an embodiment of the invention.
Figure 5B:
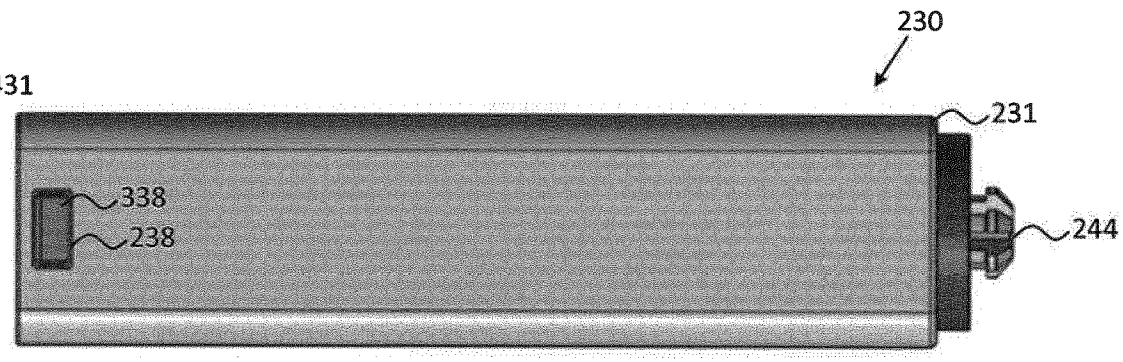
Figure 5A:
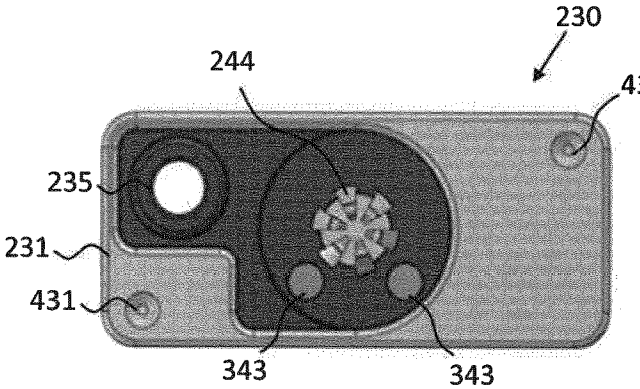
Figure 6B:
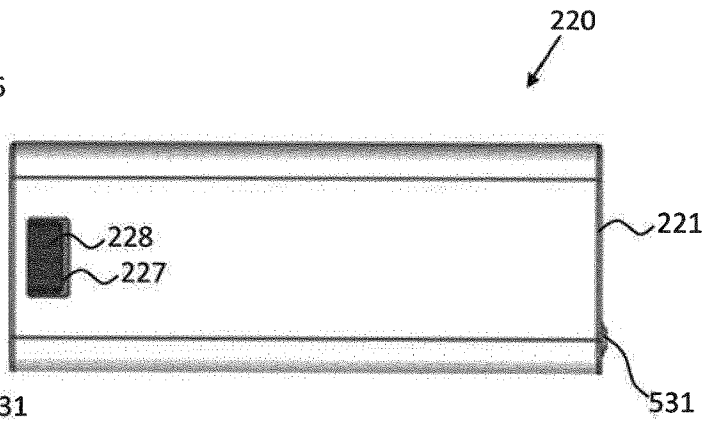
Figure 6A:
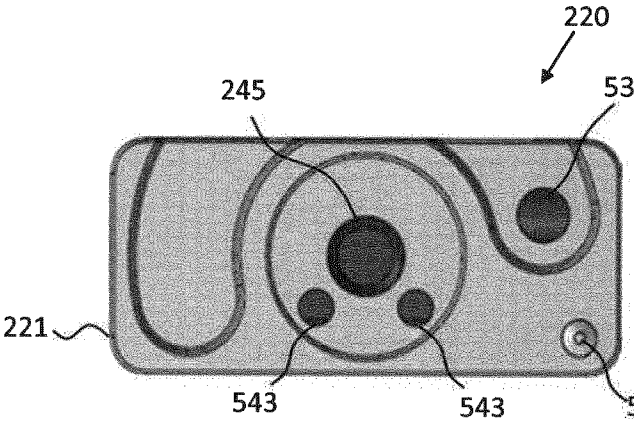
Figure 7B:
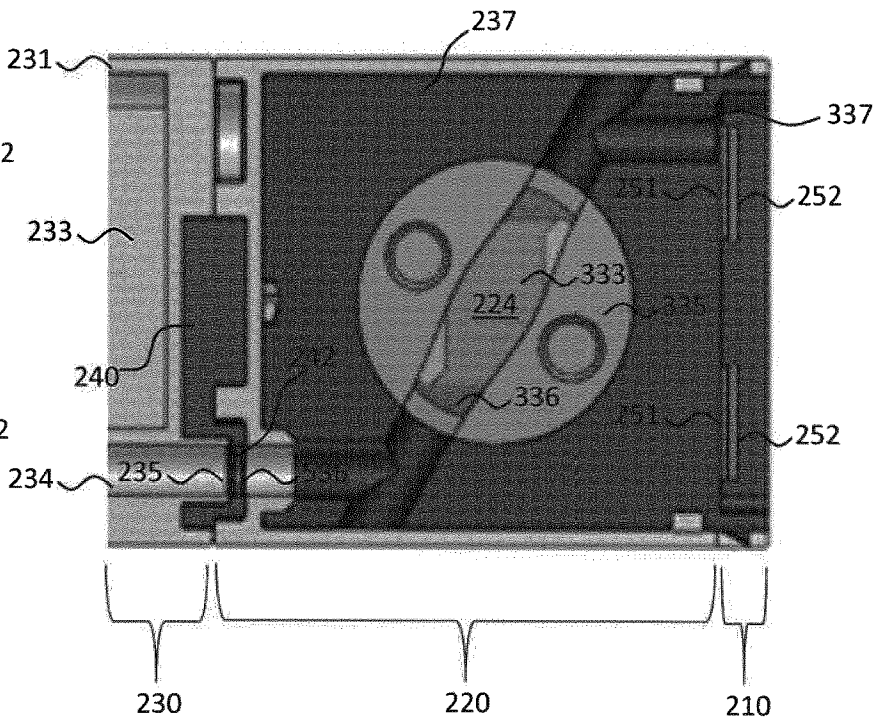
Figure 7A:
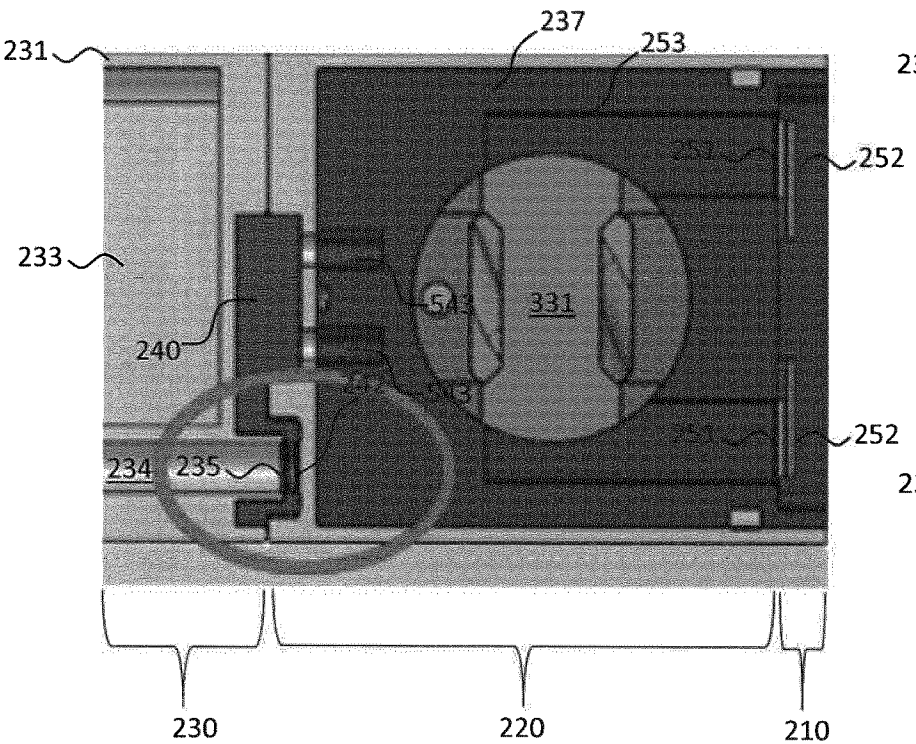
Figure 8B:
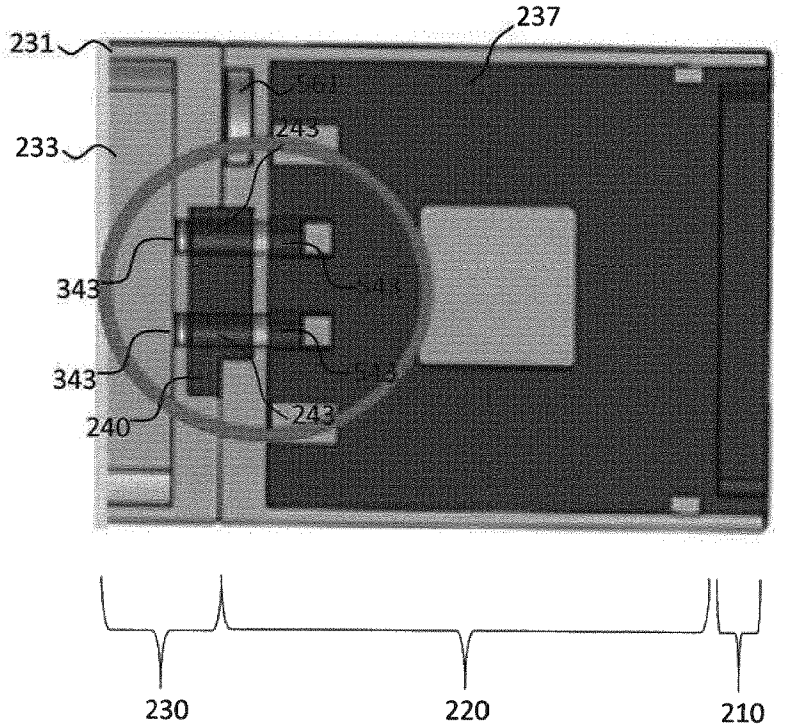
Figure 8A:
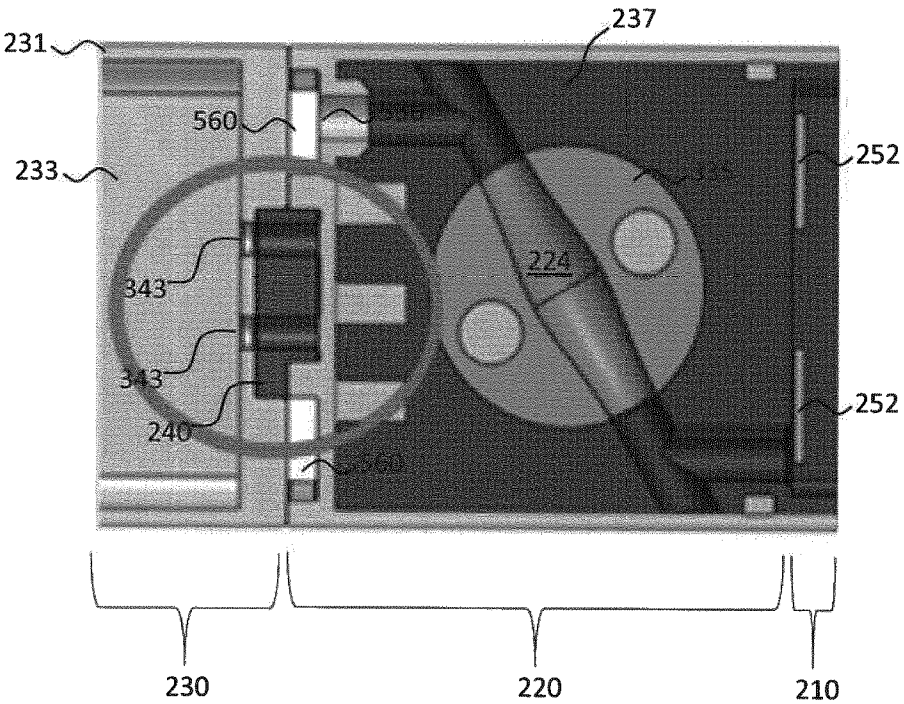
Figure 9:
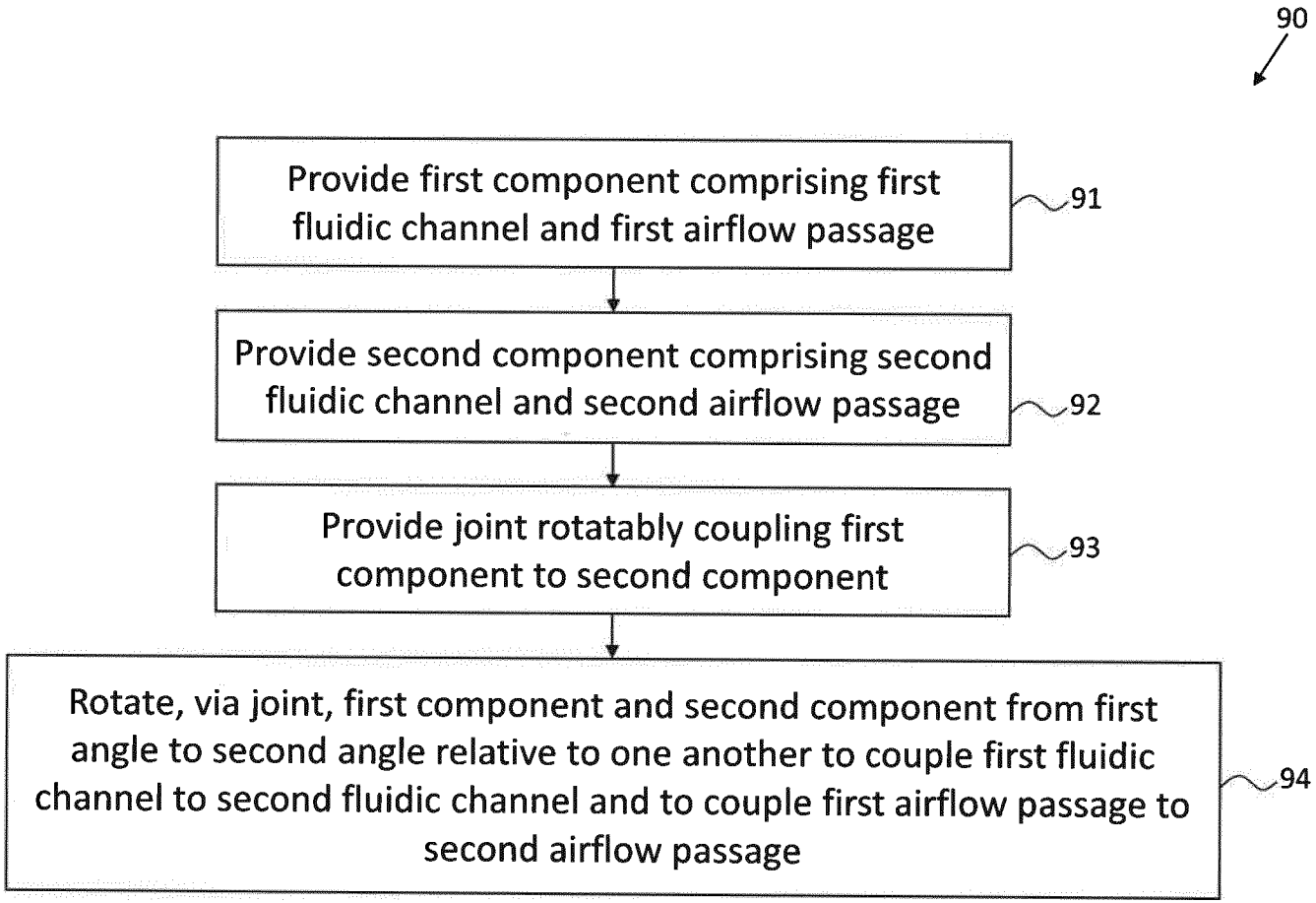

FIGS. 5A-5B respectively are end and side views of the first component of the cartridge of FIGS. 3A-3B;

FIGS. 6A-6B respectively are end and side views of the second component of the cartridge of FIGS. 3A-3B;

FIG. 7A is a plan view of selected components of a system comprising the cartridge of FIGS. 3A-3B in the first position;

FIG. 7B is a plan view of selected components of a system comprising the cartridge of FIGS. 3A-3B in the second position;

FIG. 8A is a plan view of selected components of a system comprising the cartridge of FIGS. 3A-3B in the first position;

FIG. 8B is a plan view of selected components of a system comprising the cartridge of FIGS. 3A-3B in the second position; and FIG. 9 illustrates a flow of operations in a method for generating an aerosol in accordance with the invention.

Provided herein are systems, cartridges, and methods with leakage protection.

Figure 1A:
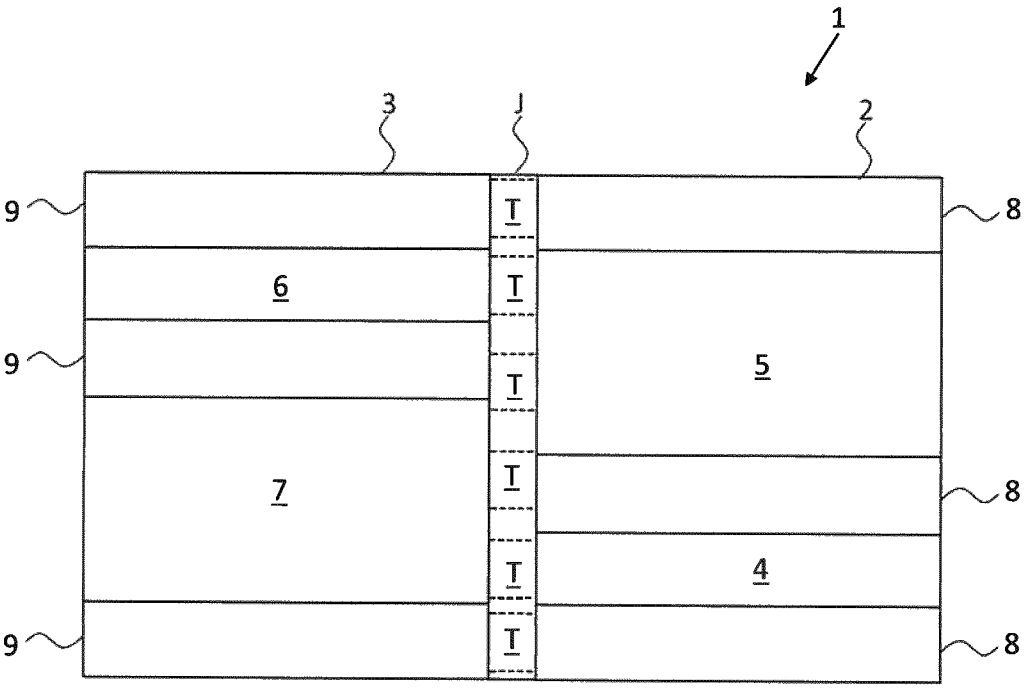
FIG. 1A is a schematic illustration of a system in a first position, in accordance with the invention.
Figure 1B:
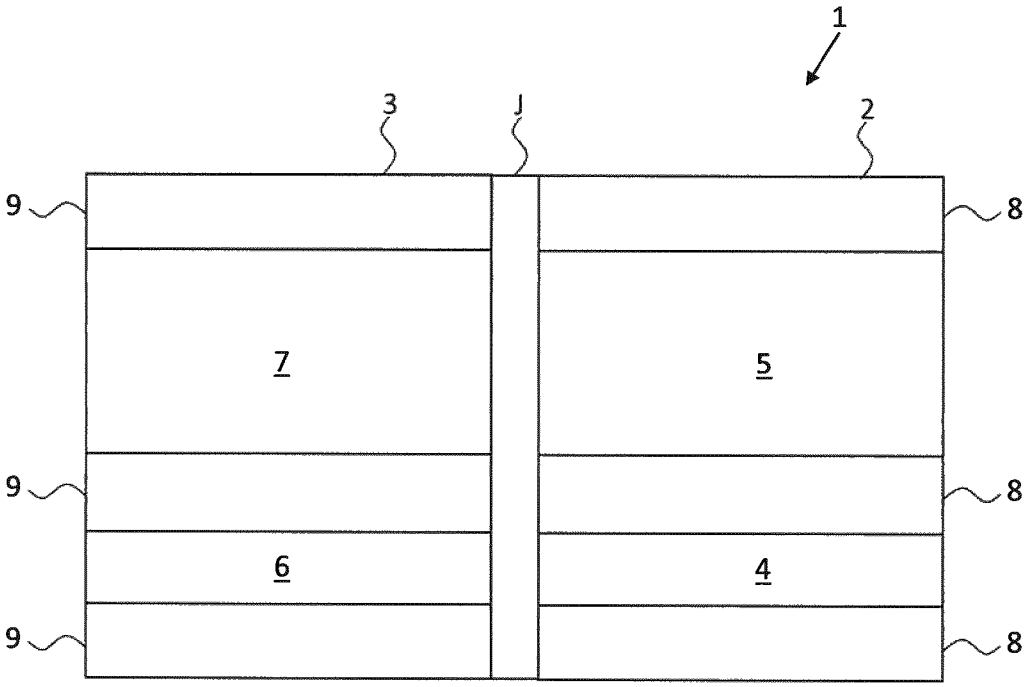
FIG. 1B is a schematic illustration of the system of FIG. 1A in a second position.

For example, FIG. 1A is a schematic illustration of a system in a first position, in accordance with the invention. FIG. 1B is a schematic illustration of the system of FIG. 1A in a second position. System 1 illustrated in FIGS. 1A-1B includes first component 2 comprising first fluidic channel 4 and first airflow passage 5; second component 3 comprising second fluidic channel 6 and second airflow passage 7; and joint J rotatably coupling the first component 2 to the second component 3. Advantageously, rotation, via joint J, of the first component 2 and the second component 3 from a first angle (such as shown in FIG. 1A) to a second angle (such as shown in FIG. 1B) relative to one another couples the first fluidic channel 4 to the second fluidic channel 6 and couples the first airflow passage 5 to the second airflow passage 7.

Optionally, system 1 further comprises a breakable member T coupled to the first component 2 and the second component 3, wherein rotation of the first component 2 and the second component 3 relative to one another breaks the breakable member T. In the nonlimiting configuration illustrated in FIG. 1A, system 1 includes a plurality of breakable members T. Breakable member(s) T each can include a tab joining first component 2 to second component 3 at the first angle, which tab can be broken responsive to twisting first component 2 relative to second component 3, e.g., manually by a user.

Figure 2A:
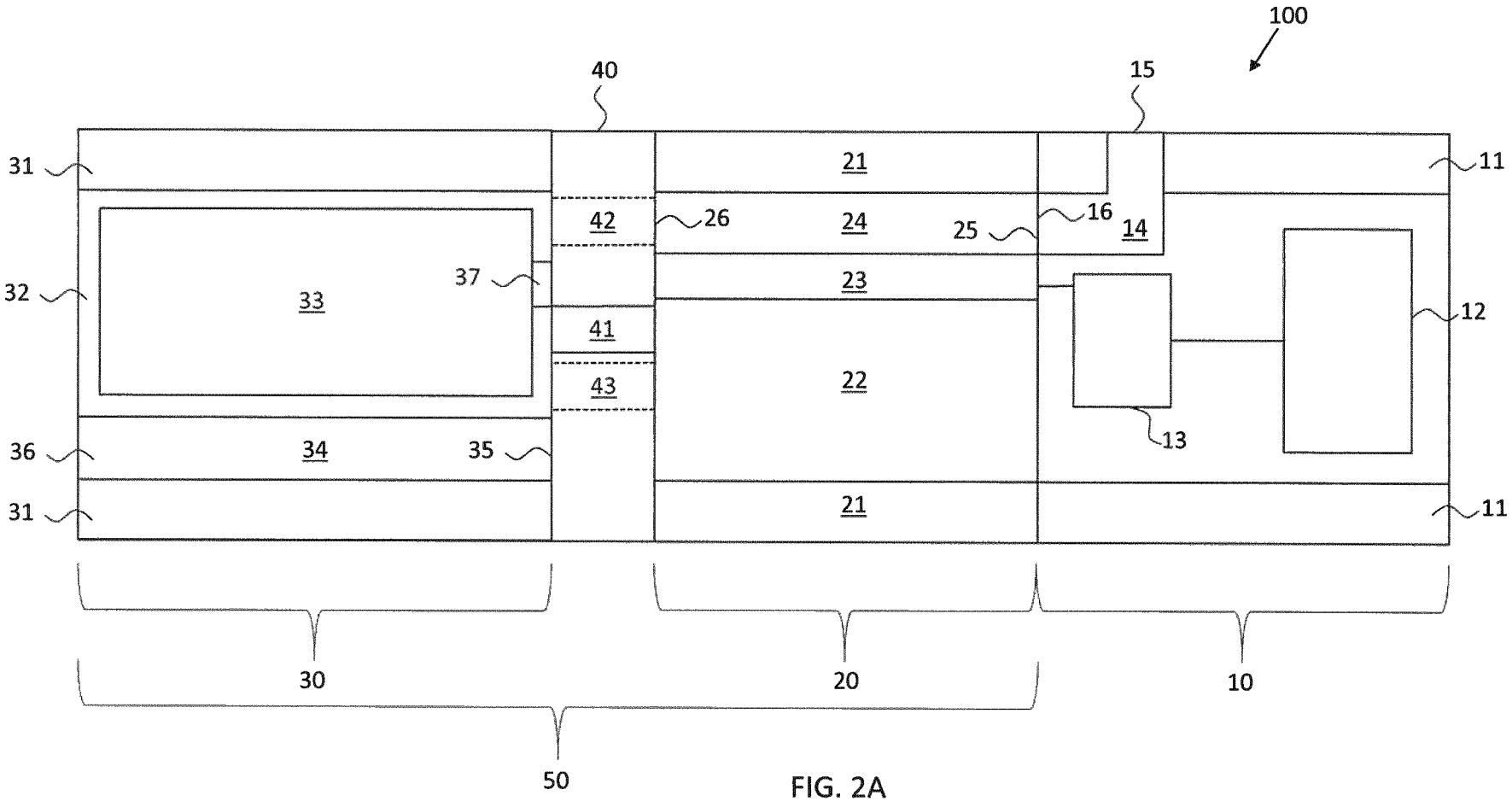
FIG. 2A is a schematic illustration of an aerosol-generating system in a first position, in accordance with the invention.
Figure 2B:
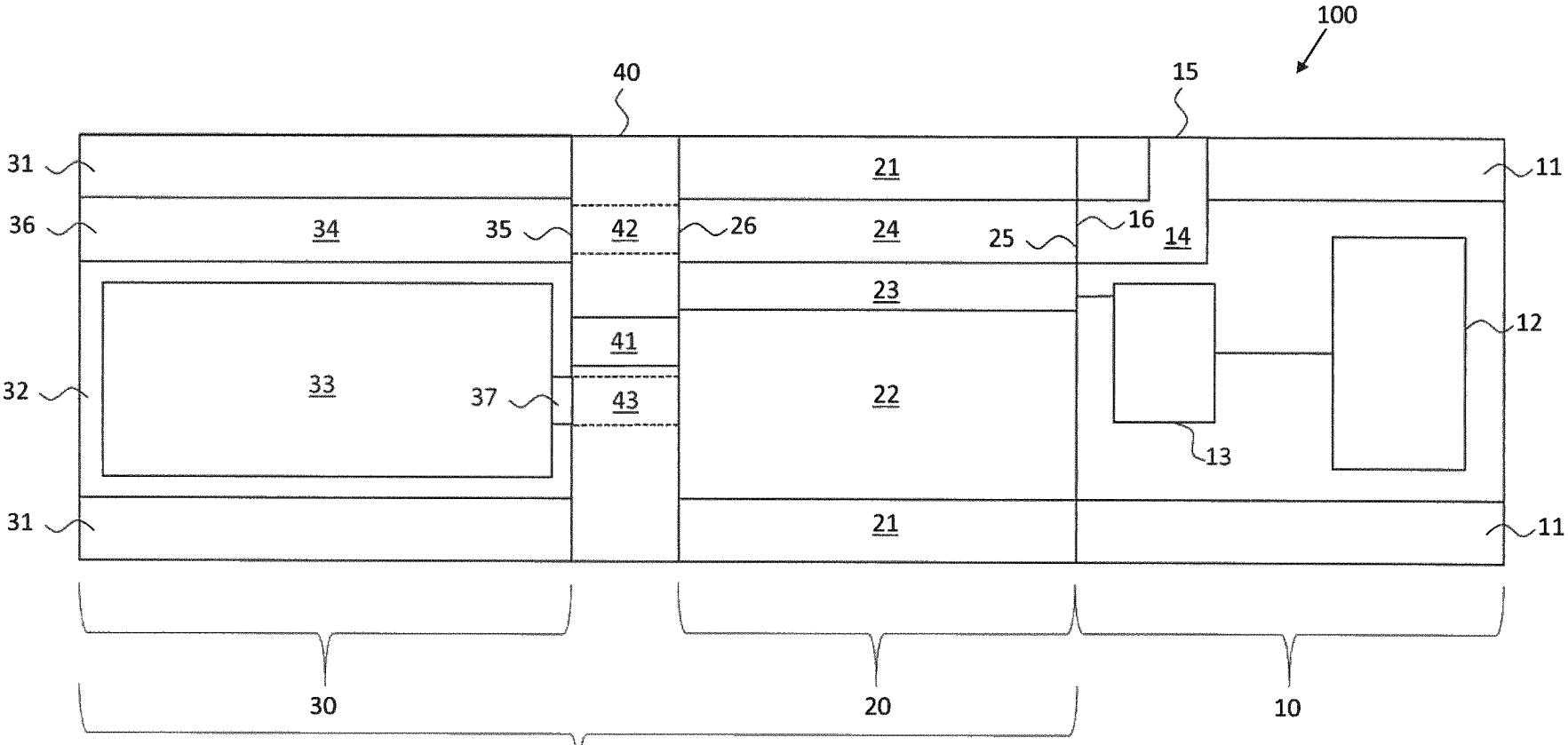
FIG. 2B is a schematic illustration of the aerosol-generating system of FIG. 2A in a second position.

FIG. 2A is a schematic illustration of an aerosol-generating system 100 in a first position, in accordance with the invention. FIG. 2B is a schematic illustration of the aerosol-generating system of FIG. 2A in a second position. The aerosol-generating system is a handheld smoking system configured to generate aerosol for user inhalation. In particular, the system shown in FIGS. 2A-2B is a smoking system that generates an aerosol containing nicotine and flavour compounds.

System 100 illustrated in FIGS. 2A-2B includes first component 30 comprising first fluidic channel 37 and first airflow passage 34; second component 20 comprising second fluidic channel 22 and second airflow passage 24; and joint 40 rotatably coupling the first component 30 to the second component 20. Advantageously, rotation, via joint 40, of the first component 30 and the second component 20 from a first angle (such as shown in FIG. 2A) to a second angle (such as shown in FIG. 2B) relative to one another couples the first fluidic channel 37 to the second fluidic channel 22 and couples the first airflow passage 34 to the second airflow passage 24.

More specifically, the system 100 of FIGS. 2A-2B comprises two parts, a device portion 10 and a cartridge 50. In use the cartridge 50 is attached to the device portion 10. Cartridge 50 comprises first component 30 and second component 20. In one exemplary configuration, second component 20 can be releasably coupled to device portion 10, and first component 30 is rotatably coupled to second component 20 via joint 40.

At a first position (first angle) of such rotatable coupling such as illustrated in FIG. 2A, the airflow passage of first component 30 is decoupled from the airflow passage of second component 20 to inhibit airflow between the first and second components. Additionally, at the first angle of such rotatable coupling, the fluidic channel of first component 30 is decoupled from the fluidic channel of second component 20 to inhibit fluidic communication, e.g., direct or indirect contact, between the aerosol-generating substrate within the reservoir of the first component 30 and the aerosol-generating element within the second component 20. As such, the first position may be considered to "seal" or the airflow passages from one another and from the fluidic channels, and can be considered to "seal" the fluidic channels, thus inhibiting leakage of the aerosol-generating substrate out of the device and/or into the airflow passages. As one option, system 100 can be purchased by a user in the first position (at the first angle).

At a second position (second angle) of such rotatable coupling such as illustrated in FIG. 2B, an airflow passage of first component 30 is coupled to an airflow passage of second component 20 to form an extended airflow passage. Additionally, in the second position of such rotatable coupling, a fluidic channel of first component 30 is coupled to a fluidic channel of second component 20 such that an aerosol-generating substrate within a reservoir of the first component 30 can be in fluidic communication, e.g., direct or indirect contact, with an aerosol-generating element within the second component 20. As one option, system 100 can be manipulated by a user into the second position (at the second angle), which may be considered to correspond to an "enabled" position.

The device portion 10 comprises a device housing 11 that holds a rechargeable battery 12 and electrical control circuitry 13. The rechargeable battery 12 is a lithium iron phosphate battery. The control circuitry 13 comprises a programmable microprocessor and an airflow sensor. Optionally, device portion 10 includes device portion air inlet 15, device portion air outlet 16, and device portion airflow passageway 14 extending therebetween.

First component 30 comprises a first air inlet 35, a first air outlet 36, a first airflow passage 34 extending therebetween, a reservoir 33 holding an aerosol-generating substrate, and an optional first fluidic channel 37 coupled to the reservoir 33. Second component 20 comprises a second air inlet 25, a second air outlet 26, a second airflow passage 24 extending therebetween, a second fluidic channel 22 (which can include or consist of one or more transport media), and an aerosol-generating element 23 coupled to the second fluidic channel 22. System 100 (or a portion thereof, e.g., cartridge 50) further can comprise a joint 40 rotatably coupling the first component 30 to the second component 20. For example, joint 40 can include a pivot 41 about which first component 30 and second component 20 can be rotated relative to one another, for example responsive to manual manipulation by the user. As one example, the pivot 41 can include a protruding member (such as an axle) and a bearing which is coupled to the first component 30 or the second component 20 and is supported by and rotates about the protruding member. Optionally, first component 30 can include one or more features, such as depressions or protrusions, which engage with one or more features of second component 20, such as protrusions or depressions respectively, so as to releaseably secure the relative positions of the first and second components at either the first or second angle until a user intentionally manipulates the joint so as to change the relative positions of the first and second components to the other of the first or second angle.

Additionally, or alternatively, system 100 optionally can include a breakable member coupled to first component 30 and second component 20, wherein rotation of the first component and the second component relative to one another breaks the breakable member. For example, in a manner analogous to that described with reference to FIGS. 1A-1B, the breakable member of system 100 can include one or a plurality of breakable members T that can inhibit inadvertent rotation of first component 30 relative to second component 20 until forcibly broken by a user manually rotating first component 30 relative to second component 20.

As illustrated in FIG. 2A, when the first and second components 30, 20 are at a first angle relative to one another, the second air outlet 26 is decoupled from the first air inlet 35 so as to inhibit airflow between the second air inlet 25 and the first air outlet 36. As also illustrated in FIG. 2A, when the first and second components 30, 20 are at the first angle relative to one another, the first fluidic channel 37 is decoupled from the second fluidic channel 22 so as to inhibit fluidic communication between the aerosol-generating element and the reservoir, for example such that the aerosol-generating substrate may not flow from the reservoir 33 so as to be in fluidic communication, e.g., direct or indirect contact, with the aerosol-generating element 32.

As illustrated in FIG. 2B, rotation via the joint 40 of the first and second components 30, 20 from the first angle to a second angle relative to one another couples the second air outlet 26 to the first air inlet 35 so as to form an extended airflow passage between the second air inlet 25 and the first air outlet 36. Optionally, joint 40 includes joint airflow passage 42 which is joined, at the second angle, to second air outlet 26 and first air inlet 35 thus permitting the flow of air therebetween; joint airflow passage 42, if present, can form part of the extended airflow passage. As also illustrated in FIG. 2B, rotation via the joint 40 of the first and second components 30, 20 from the first angle to the second angle relative to one another also couples the first fluidic channel 37 to the second fluidic channel 22 such that the aerosol-generating substrate from the reservoir 33 can be in fluidic communication, e.g., direct or indirect contact, with the aerosol-generating element 32 via the first and second fluidic channels 37, 22 to generate an aerosol (which is transmitted into the extended airflow passage 24, 42, 34). Optionally, joint 40 includes joint fluidic passage 43 which is joined, at the second angle, to second fluidic channel 22 and first fluidic channel 37 thus permitting the flow of aerosol-generating substrate therebetween; joint fluidic passage 43, if present, can form part of an extended fluidic pathway.

When the first and second components 30, 20 are at the second angle relative to one another such as shown in FIG. 2B, system 100 can be considered to be "enabled" because aerosol-generating substrate may flow from reservoir 33 of first component 30 to be in fluidic communication, e.g., direct or indirect contact, with heater 23 of second component 20 where that substrate can be heated to form a vapour, and air may flow from second component 20 to first component 30 to entrain that vapour which at least partially condenses to form an aerosol and carries that aerosol into the mouth of the user via first air outlet 36 (located at a mouthpiece of system 100). Additionally, when the first and second components 30, 20 are at the first angle relative to one another, system 100 can be considered to be "disabled" because fluidic communication between aerosol-generating substrate within reservoir 33 of first component 30 and heater 23 of second component 20 is inhibited; as such, carrying into the user's mouth of an aerosol formed based on that substrate is inhibited. Furthermore, in the "disabled" state the reservoir optionally may be sealed, thus inhibiting leakage of the aerosol-generating substrate into the airflow passageway(s). Optionally, system 100 may by default (e.g., at purchase) be in a "disabled" position, and may be rotated by a user to the "enabled" position. As a further option, after being rotated to the "enabled" position, system 100 can be rotated again by a user to the "disabled" position. As an alternative option, after being rotated to the "enabled" position, system 100 inhibits rotation again by a user to the "disabled" position and therefore remains in the "enabled" position for the remainder of its normal use. For example, optionally the first component may include one or more protrusions that securably engage with one or more recesses of the second component at the second angle, or optionally the second component may include one or more protrusions that securably engage with one or more recesses of the first component at the second angle, so as to inhibit further rotation of the first and second components relative to one another even if the user exerts significant manual twisting forces to the first and second components.

In one exemplary configuration, the first angle is about 180 degrees relative to the second angle. In another exemplary configuration, the first angle is about 90 degrees relative to the second angle. However, it should be appreciated that the first angle can be at any suitable number of degrees relative to the second angle, e.g., from about 10 degrees to about 180 degrees, or from about 30 degrees to about 150 degrees, or from about 45 degrees to about 120 degrees, or from about 60 degrees to about 90 degrees, or from about 60 degrees to about 180 degrees, or from about 90 degrees to about 180 degrees. Additionally, note that throughout the present disclosure, reference to angles or positions as being "first" or "second" is arbitrary. For example, the configuration shown in FIG. 2A equivalently may be considered to be at a second position (second angle) and the configuration shown in FIG. 2B equivalently may be considered to be at a first position (first angle).

Within cartridge 50, second component 20 comprises a second housing 21 that is releasably attached to the device housing 11, for example by a snap-fit connection. The second housing 21 holds an aerosol-generating element 23, which in one configuration is or includes a heating element. The heating element may, for example, be or include a resistive heating element. Power may be provided to the aerosol-generating element 23 (e.g., heating element) from the battery 12, under the control of the control circuitry 13. Such power can be conducted from battery 12 to aerosol-generating element 23 via any suitable combination of conductive materials, such as metal(s).

Within cartridge 50, first component 30 comprises a first housing 31 that is rotatably attached to second housing 21 via joint 40. First housing 31 holds an aerosol-forming substrate in condensed form within reservoir (substrate chamber) 33. In some configurations, reservoir 33 is bounded by sidewall 32 and first housing 31 and fluidically coupled to aerosol-generating element 23 via first fluidic channel 37, optional joint fluidic passage 43, and second fluidic channel 22 which may comprise or consist of a channel and/or one or more transport media (such as one or more capillary materials), In this example, the aerosol-forming substrate is a liquid mixture at room temperature and comprises nicotine, flavours, an aerosol-former, such a glycerol or propylene glycol, and water. However, it should be understood that any other condensed form of aerosol-forming substrate suitably can be used. In some configurations, one or more transport media, such as one or more capillary materials, can be provided in the reservoir 33 and can be arranged to promote delivery of the aerosol-forming substrate to the aerosol-generating element 23 via first fluidic channel 37, joint fluidic passage 43, and second fluidic channel 22 regardless of the orientation of the system 100 relative to gravity.

An extended airflow passage including elements 14, 24, 34 (optionally including joint air flow passage 42) is provided through the system 100, for example when the first component 30 is at or about at the second angle relative to the second component 20 such as shown in FIG. 2B. In this example, a portion including elements 24, 42, 34 of the extended airflow passage is through the cartridge 50 and a portion 14 of the extended airflow passage is through the device portion 10. The airflow sensor included in the control circuitry 13 is positioned to detect airflow through the portion 14 of the airflow passage in the device 10. The airflow passage of system 100 extends from an air inlet 15 to first air outlet 36. Within device portion 10, the device portion airflow passage 14 extends from device portion air inlet 15 to device portion air outlet 16, for example when the first component 30 is at or about at the second angle relative to the second component 20. Within second portion 20, second airflow passage 24 extends from second air inlet 25 to second air outlet 26, and second air inlet 25 receives air from air outlet 16 of device 10 independently of the angle between first portion 30 and second portion 20. Within first portion 30, first airflow passage 34 extends from first air inlet 35 to first air outlet 36, and first air inlet 35 receives air from second air outlet 26 when the first component 30 is at or about at the second angle relative to the second component 20. The first air outlet 36 is in a mouthpiece end of the cartridge 50, which also forms a mouthpiece end of first component 30. When the user puffs on the mouthpiece end of the cartridge 50 when the first component 30 is at or about at the second angle relative to the second component 20, air is drawn from the air inlet 15, through the extended airflow passage including elements 14, 24, 42, 34 to the first air outlet 36. In comparison, if the user were to puff on the mouthpiece end of the cartridge 50 when the first component 30 is at or about at the first angle relative to the second component 20 such as shown in FIG. 2A, air may be drawn only from first airflow passage 34 because of the disruption caused to extended airflow passage including elements 14, 24, 42, 34 by joint 40 at this first angle.

In the configuration illustrated in FIGS. 2A-2B, aerosol-generating element 23 is generally planar and is positioned between second fluidic channel 22 and second airflow passage 24. Aerosol-generating element 23 can be arranged substantially parallel to second airflow passage 24. In operation of one exemplary configuration, aerosol-generating element 23 vapourises, for example by heating, the aerosol-forming substrate to form a vapour. The vapour can pass through the aerosol-generating element 23, e.g., a mesh heating element, into the extended airflow passage including elements 24, 42, 34 when the first component 30 is at or about the second angle relative to the second component 20. The vapour is entrained in the air flowing through the extended airflow passage and cools to form an aerosol before exiting the system through the first air outlet 36.

The system 100, consisting in this example of a device portion 10 and a cartridge 50, is elongate, having a length significantly greater than its width or its thickness. The mouthpiece end is at one end of the length of the system 100, e.g., can be located at the end comprising first air outlet 36. This shape allows the system 100 to be comfortably held by a user in a single hand when using the system. The length of the system 100 may be said to extend in a longitudinal direction. When the first component 30 is at or about the second angle relative to the second component 20 such as shown in FIG. 2B, the extended airflow passage including elements 14, 24, 42, 34 extends in the longitudinal direction past the aerosol-generating element 23. However, the extended airflow passage including elements 14, 24, 42, 34 need not necessarily be linear, but instead can include one or more segments that are disposed at an angle of other than 180 degrees relative to one or more other of the segments. A non-limiting example of such a non-linear arrangement is described below with reference to FIGS. 3A-8B. The aerosol-generating element 23 can be generally planar and can extend parallel to the longitudinal direction. The aerosol-generating element 23 may also be elongate, with its length extending in the longitudinal direction. This arrangement allows for a heating element with a relatively large surface area to be accommodated in a slim, easy to hold system.

In operation, the aerosol-generating element 23 may be activated, by control circuitry 13, only during user puffs or may be activated continuously following the system 100 being switched on, e.g., via a switch within device portion 10 and operably coupled to control circuitry 13. In the first case, user puffs are detected when the flow sensor (part of control circuitry 13, not specifically illustrated) detects an airflow through the device portion airflow passage 14 above a threshold airflow rate. In response to the output of the flow sensor, the control circuitry 13 supplies power to the aerosol-generating element 23. The supply of power to the aerosol-generating element 23 may be provided for a predetermined period of time following detection of a user puff or may be controlled until a switch-off condition is met, based on signals from the flow sensor and/or based on other inputs received from by the control circuitry 13, such as measures of aerosol-generating element 23 temperature or resistance. In one example, the aerosol-generating element 23 is supplied with 6 Watts of power for 3 seconds following detection of a user puff. When the aerosol-generating element 23 is supplied with power it heats up. When it is sufficiently hot, the liquid aerosol-forming substrate in proximity to the aerosol-generating element 23 is vapourised and enters second airflow passage 24.

In the second case, the aerosol-generating element 23 is supplied with power continuously during operation by control circuitry 13, following activation of the system 100. Activation may be based on a user input to the system, such as pressing a button or otherwise activating a switch in operable communication with control circuitry 13. In one embodiment, the aerosol-generating element 23 is supplied with 3.3 Watts of power following activation of the device, regardless of user puffs. Again, this may be adjusted based on other inputs to the control circuitry 13, such as measured aerosol-generating element 23 temperature or resistance. The system may be switched off following a predetermined time after activation or based on a further user input.

As another alternative, a hybrid power supply scheme may be used in which a lower power, such as 3.3 Watts is supplied between user puffs but a higher power, such as 7 Watts, is supplied for 2 seconds following detection of each user puff. This may result in a greater volume of aerosol being generated.

When the first component 30 is at or about the second angle relative to the second component 20, the vapour generated passes through aerosol-generating element 23 from which the vapour is entrained in the airflow through the second airflow passage 24 and from there into optional joint airflow passage 42 and the first airflow passage 34. The vapour cools within the extended airflow passage to partially or fully form an aerosol. The aerosol passes through the first air outlet 36 and into the user's mouth.

In configurations including capillary material or other transport media within or as second fluidic channel 22, the condensed form of the aerosol-generating substrate (e.g., liquid or gel) that is vapourised by aerosol-generating element 23 leaves the capillary material. This condensed form (e.g., liquid or gel) is replaced by condensed form (e.g., liquid or gel) still remaining in the reservoir, so that there is condensed form (e.g., liquid or gel) proximate to the aerosol-generating element 23 ready for the next user puff. It will be appreciated that when the first component 30 is at or about the first angle relative to the second component 20, aerosol-generating substrate may remain within the fluidic channel (e.g., capillary material) even though the flow of additional fluid from reservoir 33 to second fluidic channel 22 is inhibited at that first angle.

It is possible that not all of the vapoured aerosol-forming substrate is drawn out of the system 100 by the user puffs. In that case, the aerosol-forming substrate may condense to form large droplets within airflow passage 24. It may also be possible for some liquid to pass through the aerosol-generating element 23 without being vapourised, either during use or between uses of the system. Optionally, a gas-permeable element may be provided so as to inhibit transport of the condensed form of the aerosol-generating substrate into airflow passage 24, such that large droplets or larger amounts of the condensed form of the aerosol-generating substrate may not be drawn into the user's mouth via the extended airflow passage, thus improving user experience. A nonlimiting example of such a gas-permeable element is provided elsewhere herein.

Figure 4:
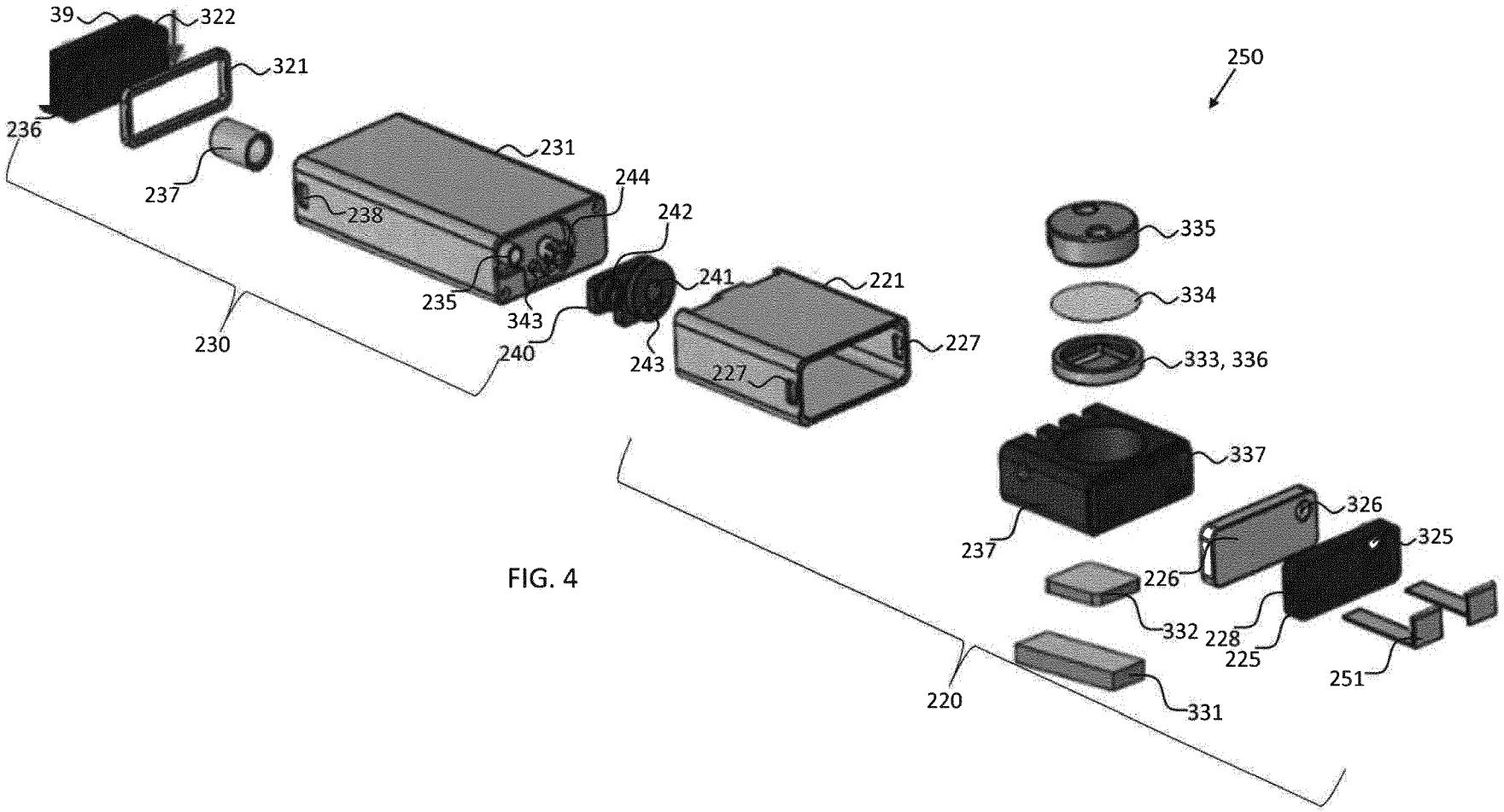
FIG. 4 is an exploded view of the cartridge of FIGS. 3A-3B.

FIG. 3A is a perspective view of a cartridge in a first position, in accordance with an embodiment of the invention. FIG. 3B is a perspective view of the cartridge of FIG. 3A during rotation to a second position. FIG. 4 is an exploded view of the cartridge of FIGS. 3A-3B. FIGS. 5A-5B respectively are end and side views of the first component of the cartridge of FIGS. 3A-3B. FIGS. 6A-6B are end and side views of the second component of the cartridge of FIGS. 3A-3B. FIG. 7A is a plan view of selected components of a system comprising the cartridge of FIGS. 3A-3B in the first position. FIG. 7B is a plan view of selected components of a system comprising the cartridge of FIGS. 3A-3B in the second position. FIG. 8A is a plan view of selected components of a system comprising the cartridge of FIGS. 3A-3B in the first position. FIG. 8B is a plan view of selected components of a system comprising the cartridge of FIGS. 3A-3B in the second position.

The cartridge 250 illustrated in FIGS. 3A-8B includes first component 230, second component 220, and joint 240. Second component 220 can be releasably coupled to a device portion 210 which may be configured analogously to device portion 10 described above with reference to FIGS. 2A-2B. Second component 220 and first component 230 are rotatable relative to one another via joint 240 in a manner analogous to that described above with reference to FIGS. 2A-2B. For example, as shown in FIGS. 3A and 3B, first component 230 and second component 220 can be rotated relative to one another via joint 240 using a twisting motion, for example by manual manipulation by a user.

First component 230 comprises first fluidic channel 343 and first airflow passage 234, and second component 220 comprises second fluidic channel 543 and second airflow passage 224. Advantageously, rotation, via joint 240, of the first component 230 and the second component 220 from a first angle (first position) (such as shown in FIGS. 7A and 8A) to a second angle (second position) (such as shown in FIG. 2B) relative to one another couples the first fluidic channel 343 to the second fluidic channel 543 and couples the first airflow passage 234 to the second airflow passage 224. Optionally, a breakable member (e.g., one or a plurality of breakable members T such as described with reference to FIGS. 1A-1B) can be coupled to first component 230 and to second component 220 so as to inhibit inadvertent rotation of the first and second components from the first angle relative to one another, and intentional rotation of the first component and second component relative to one another can break the breakable member(s).

Second component 220 comprises an external housing 221 and internal housing 237. Internal housing 237 securably engages with external housing 221, e.g., in a snug slip-fit engagement or other suitable engagement that inhibits separation of internal housing 237 from external housing 221 during normal use.

Within second component 220, the internal housing 237 holds first and second capillary materials (two or more transport media) 331, 332, heater assembly 333, 336, optional gas-permeable element 334, and inner lid 335. As particularly may be understood from FIG. 7A, second airflow channel 224 can be defined through internal housing 237. The heater assembly comprises a heater mount 336 which supports liquid-permeable heating element 333, or other suitable aerosol-generating element such as described elsewhere herein, adjacent to second airflow channel 224. Internal housing 237 holds capillary materials 331, 332 within the heater mount 336 and at least one of which is in fluidic communication, e.g., direct or indirect contact, with the heating element 333. Second component 220 also comprises electrical contact elements 251 that extend between the mesh heating element 333 and an external surface of the cartridge, at the device portion end of the cartridge 250 (opposite the mouthpiece end of the cartridge). The electrical contact elements 251 interface with corresponding electrical contacts 252 on device portion 210 of the system to allow for the supply of power to the heating element 333 by a battery (e.g., battery 12) under the control of control circuitry (e.g., control circuitry 13). A connector joint 226 couples outer lid 225 to internal housing 237, and electrical contact elements 251 extend through outer lid 225 to electrically contact heater 333 via conductive wires 253 in a manner such as illustrated in FIG. 7A.

Optional gas-permeable element 334 is clamped to the heater assembly within the internal housing 237 by inner lid 335 which fits within and engages with an interior surface of internal housing 237, e.g., in a snug slip-fit engagement or other suitable engagement that inhibits leakage of aerosol-generating substrate in condensed form around the outer sidewalls of lid 335. Mount 336 can space apart gas-permeable element 334 from mesh heating element 333 so as to provide a cavity between elements 333, 334 within which the condensed form of the aerosol-generating substrate, such as liquid droplets which condense within the cavity or leak through heating element 333, may collect. Gas-permeable element 334 may be hydrophobic and may inhibit transmission of the condensed form of the aerosol-generating substrate into the airflow passage. In one exemplary configuration, the optional gas-permeable element 334 comprises a mesh of stainless steel wire having a diameter of about 50 μm. The apertures of the mesh have a diameter of about 100 μm. The mesh can be coated with silicon carbide.

Additionally, or alternatively, the mesh of the heating element 333 also can be formed from stainless steel and has a mesh size of about 400 Mesh US (about 400 filaments per inch). The filaments can have a diameter of around 16 μm. The filaments forming the mesh can define interstices between the filaments. The interstices in this example have a width of around 37 μm, although larger or smaller interstices may be used. Using a mesh of these approximate dimensions allows a meniscus of aerosol-forming substrate to be formed in the interstices, and for the mesh of the heater assembly to draw aerosol-forming substrate by capillary action. The open area of the heating element mesh, i.e. the ratio of the area of interstices to the total area of the mesh is advantageously between 25 and 56%. The total electrical resistance of the heater assembly is around 1 Ohm.

First component 230 includes housing 231 within which a reservoir 233, first fluidic channel(s) 343, and first airflow channel 234 are defined in a manner analogous to that described in FIGS. 2A-2B. Additionally, in the exemplary configuration illustrated in FIGS. 3A-8B, first component 230 includes axle 244 which engages with a corresponding aperture 245 of second component 220 so as to inhibit separation of first component 230 from second component 220 during normal use. Additionally, axle 244 supports joint 240 so as to provide rotation of first component 230 and second component 220 relative to one another about a longitudinal axis, e.g., about axle 244, via joint 240. However, it should be understood that second component 220 instead may include such an axle 244 and that first component 230 instead may include a corresponding aperture 245, and that any other suitable structure or combination of structures may be provided so as to permit rotation of first component 230 relative to second component 220 about a longitudinal axis.

First component 230 further can include tube joint 237, seal joint 321, and mouthpiece lid 239 having defined therethrough aperture 236, corresponding to a first air outlet. Tube joint 237 includes an aperture therethrough which sealingly joins the end of first airflow channel 234 to aperture 236, and seal joint 321 sealingly joins mouthpiece lid 239 to housing 231, e.g., in such a manner as to enclose reservoir 233 and inhibit leakage of aerosol-generating substrate around mouthpiece lid 239.

Joint 240 includes bearing 241, joint airflow passage 242, and one or more joint fluidic passage(s) (e.g., two or more joint fluidic passages) 243. Bearing 241 is configured to receive axle 244 and allow axle 244 to pass therethrough so as to engage with aperture 245 of second component 220. Joint 240 may include or may be formed of an elastomeric material or combination of materials configured to provide an air tight seal so as to inhibit leakage of air flowing from second component 220 to first component 230 when the first component 230 and the second component 220 are at the second angle relative to one another, and optionally also so as to inhibit flow of air through cartridge 250 when the first component 230 and the second component 220 are at the first angle relative to one another. Additionally, or alternatively, joint 240 may be configured to provide a liquid tight seal so as to inhibit leakage of the aerosol-generating substrate flowing from first component 230 to second component 220 when the first component 230 and the second component 220 are at the second angle relative to one another, and optionally also so as to inhibit flow of the aerosol-generating substrate out of cartridge 250 when the first component 230 and the second component 220 are at the first angle relative to one another. Examples of suitable elastomeric materials for use in joint 240 include silicone, rubber, polyurethane, Teflon, and nylon.

When the first component 230 and the second component 220 are at the first angle relative to one another (such as illustrated in FIGS. 7A and 8A) the first airflow passage 234 is decoupled from the second airflow passage 224 and optionally is sealed by the material of joint 240. More specifically, the relative position of first component 230 and second component 220 at the first angle relative to one another about axle 244 physically separates (decouples) second air outlet 536 from first air inlet 235 and from joint airflow passage 242, thus inhibiting airflow between the second air inlet (e.g., 325, 326, and/or 337) and the first air outlet 236 such that puffing by a user on mouthpiece lid 239 does not induce flow of air through second airflow passage 224, thus inhibiting transmission of vapour and/or aerosol of the aerosol-generating substrate into the mouth of the user.

When the first component 230 and the second component 220 are at the first angle relative to one another (such as illustrated in FIGS. 7A and 8A), the first fluidic channel(s) 343 are decoupled from the second fluidic channel(s) 543 and optionally are sealed by the material of joint 240. More specifically, the relative position of first component 230 and second component 220 at the first angle relative to one another about axle 244 physically separates (decouples) the first fluidic channel(s) 343 from the second fluidic channel(s) 543 and optionally physically separates (decouples) the second fluidic channel(s) 543 from joint fluidic channel(s) 243, thus inhibiting fluidic communication, e.g., direct or indirect contact, between mesh heating element 333 and reservoir 233.

When the first component 230 and the second component 220 are at the second angle relative to one another (such as illustrated in FIGS. 7B and 8B), joint airflow passage 242 couples the first airflow passage 234 to the second airflow passage 224 so as to provide an extended airflow passage through which air may be drawn responsive to puffing by a user at mouthpiece lid 236. More specifically, within second component 220, aperture 325 defined through outer lid 225 and aperture 326 defined through connector joint 226 provide an airflow passage connecting to aperture 337 defined through internal housing 237. Aperture 337 is coupled to second airflow passage 224 defined within internal housing 237. Any of aperture 337, aperture 325, and/or aperture 326 may be considered to correspond to a second air inlet. Airflow passage 224 is coupled to second air outlet 536 in a manner such as illustrated in FIG. 7B. Within first component 230, first air inlet 235 is defined within housing 231 and is coupled to first airflow passage 234. First airflow passage 234 is coupled to tube joint 237 and to aperture 236 providing a first air outlet at the mouthpiece. When the first component 230 and the second component 220 are at the second angle relative to one another, responsive to puffing by a user at mouthpiece lid 236, air flows through apertures 325, 326, 337 and into second airflow passage 224 where the air passes by heating element 333 causing vapour of the aerosol-generating substrate to be entrained in the air. The air then flows out of second air outlet 536 and into first air inlet 235 through joint airflow passage 242 (the surrounding material of which seals against air leakage between second air outlet 536 and first air inlet 235), through first airflow passageway 234, through tube joint 237, through aperture 236 corresponding to a first air outlet within the mouthpiece lid 239, and then into the user's mouth. The vapour entrained in the flowing air may fully or partially condense to an aerosol within any suitable portion of the extended airflow passage formed by the elements of cartridge 250, prior to entering the mouth of the user.

When the first component 230 and the second component 220 are at the second angle relative to one another (such as illustrated in FIGS. 7B and 8B) joint fluidic passage(s) 243 couple reservoir 233 to heating element 333 or other suitable aerosol-generating element such that heating element 333 can volatilize aerosol-generating substrate into air flowing through the extended airflow passage responsive to puffing by a user at mouthpiece lid 236. More specifically, within first component 230, aerosol-generating substrate within reservoir 233 flows through one or more (e.g., two or more) first fluidic channels 343 into corresponding one or more (e.g., two or more) second fluidic channels 543 within second component 220 via one or more (e.g., two or more) joint fluidic channels 243 within joint 240, the surrounding material of which seals against fluid leakage between first fluidic channel(s) 343 and second fluidic channel(s) 543. After passing through second fluidic channel(s) 543, aerosol-generating substrate flows into capillary materials 331, 332 which conduct the aerosol-generating substrate to heating element 333 and which also or alternatively may be considered to correspond to a second fluidic channel. As noted above, when the first component 230 and the second component 220 are at the second angle relative to one another, responsive to puffing by a user at mouthpiece lid 236, air flows through apertures 325, 326, 337 and into second airflow passage 224 where the air passes by heating element 333 causing vapour of the aerosol-generating substrate to be entrained in the air and eventually enter the mouth of the user via the extended airflow passage in a manner such as described above.

First component 230 and/or second component 220 optionally may include one or more cooperating features configured so as to inhibit inadvertent rotation of the first and second components relative to one another at times when the user is not intentionally changing the angle between such components. For example, first component 230 optionally can include one or more depressions 431 and second component 220 optionally can include one or more protrusions 531 which engage with such depression(s) so as to inhibit inadvertent rotation of the first and second components relative to one another. It should be understood that alternatively, first component 230 can include analogous protrusions and second component 220 can include analogous depressions which engage with such protrusion(s) so as to inhibit inadvertent rotation of the first and second components relative to one another. Optionally, such protrusion(s) and depressions can engage sufficiently strongly with one another as to resist even strong attempts by the user to twist first component 230 and second component 220 relative to one another, thus effectively locking the system at the second angle during normal use.

Additionally, or alternatively, optionally second component 220 and/or first component 230 can include one or more recesses or protrusions configured to facilitate rotation of the first and second components relative to one another and/or to inhibit rotation of such components beyond a specified angle. For example, second component 220 optionally can include semicircular depression 560 and first component optionally can include protrusion 561 that fits within depression 560. When second component 220 and first component 230 are rotated relative to one another to a first limiting position (e.g., corresponding to the first angle), protrusion 561 contacts a first end of depression 560 thus inhibiting relative rotation of the first and second components beyond that position. When second component 220 and first component 230 are rotated in the other direction relative to one another to a second limiting position (e.g., corresponding to the second angle), protrusion 561 contacts a second end of depression 560 thus inhibiting relative rotation of the first and second components beyond that position.

The cartridge 250 of FIGS. 3A-8B is simple to assemble. For second component 220, the assembly of the internal housing 237, the capillary material(s) 331, 332, the heater assembly including elements 333, 336, the optional gas-permeable element 334, inner lid 335, connector joint 226, outer lid 225, and connectors 251 may be described as an atomiser assembly. The atomiser assembly is assembled first. The atomiser assembly is then pushed into the external housing 221. Optionally, a pair of protrusions 228 on the outer lid 225 snap into corresponding apertures or slots 227 on the external housing 221 to secure the internal housing 237 within the external housing 221. For first component 230, air outlet 236 can include a protrusion that can be inserted into tube joint 237, seal joint 321 can be inserted into a depression 322 within mouthpiece lid 239, and mouthpiece lid 239 can be inserted into housing 231. Optionally, mouthpiece lid 239 can include a pair of protrusions 338 that snap into corresponding apertures or slots 238 on housing 231 to secure mouthpiece lid to housing 231. The chamber 233 holding the aerosol-forming substrate can be defined by housing 231 and optionally also by mouthpiece lid 239. The housing 231 may contain the liquid (or another condensed phase) aerosol-forming substrate before the mouthpiece lid 239 is attached. Alternatively, the aerosol-forming substrate chamber may be filled after the mouthpiece lid 239 is attached to the housing 231 through a filling port (not shown). Joint 240 can be pressed over axle 244 of first component 230, and the axle engaged with aperture 245 of second component 220 so as to rotatably secure first component 230 and second component 220 with one another. Device 210 can be releasably connected to the cartridge 250 via second component 220. Each of the various parts of the first components, second components, joints, and devices provided herein may be formed from any suitable material or combination of materials, such as metal or robust plastics materials, e.g., a heat resistant plastics material and/or an elastomeric plastics material.

The cartridge of FIGS. 3A-8B operates in the manner described in relation to FIGS. 1A-1B and 2A-2B.

FIG. 9 illustrates a flow of operations in a method 80 for generating an aerosol in accordance with the invention. The operations in method 80 may be implemented using system 1 described with reference to FIGS. 1A-1B and/or with system 100 described with reference to FIGS. 2A-2B and/or with cartridge 520 described with reference to FIGS. 3A-8B, but is not limited thereto.

Method 90 illustrated in FIG. 9 includes providing a first component comprising a first fluidic channel and a first airflow passage (operation 91). For example, first component 2 described with reference to FIGS. 1A-1B can include first fluidic channel 4 and first airflow passage 5. Or, for example, first component 30 described with reference to FIGS. 2A-2B can include first fluidic channel(s) 37 and first airflow passage 34. Or, for example, first component 230 described with reference to FIGS. 3A-8B can include first fluidic channel(s) 343 and first airflow passage 234.

Method 90 illustrated in FIG. 9 also includes providing a second component comprising a second fluidic channel and a second airflow passage (operation 92). For example, second component 3 described with reference to FIGS. 1A-1B can include second fluidic channel 6 and second airflow passage 7. Or, For example, second component 20 described with reference to FIGS. 2A-2B can include second fluidic channel(s) 22 and second airflow passage 24. Or, for example, second component 220 described with reference to FIGS. 3A-8B can include second fluidic channel(s) 543 and second airflow passage 224.

Method 90 illustrated in FIG. 9 also includes providing a joint rotatably coupling the first component to the second component (operation 93). For example, joint J described with reference to FIGS. 1A-1B can rotatably couple first component 2 to second component 3. Or, for example, joint 40 described with reference to FIGS. 2A-2B can rotatably couple first component 30 to second component 20. Or, for example, joint 240 described with reference to FIGS. 3A-8B can rotatably couple first component 230 to second component 220.

Method 90 illustrated in FIG. 9 also can include rotating, via the joint, the first component and second component from a first angle to a second angle relative to one another to couple the first fluidic channel to the second fluidic channel and to couple the first airflow passage to the second airflow passage (operation 94). For example, first component 30 described with reference to FIGS. 2A-2B can be rotated from a first angle to a second angle relative to second component 20 to couple the first fluidic channel 37 to the second fluidic channel 22 and to couple the first airflow passage 34 to the second airflow passage 24. Or, for example, first component 230 described with reference to FIGS. 3A-8B can be rotated from a first angle to a second angle relative to second component 220 to couple the first fluidic channel(s) 343 to the second fluidic channel(s) 543 and to couple the first airflow passage 234 to the second airflow passage 224. Such joining of fluidic channels may allow fluidic communication, e.g., direct or indirect contact, between aerosol-generating substrate, which may be in a reservoir, and an aerosol-generating element, such as a heater.

Optionally, method 90 illustrated in FIG. 9 also can include rotating, via the joint, the first component and second component from the second angle to the first angle relative to one another to decouple the first fluidic channel from the second fluidic channel and to decouple the first airflow passage from the second airflow passage. For example, first component 2 described with reference to FIGS. 1A-1B can be rotated from the second angle to the first angle relative to second component 3 to decouple the first fluidic channel 4 from the second fluidic channel 6 and to decouple the first airflow passage 5 from the second airflow passage 7, thus inhibiting airflow between the first and second airflow passages. For example, first component 30 described with reference to FIGS. 2A-2B can be rotated from the second angle to the first angle relative to second component 20 to decouple the first fluidic channel 37 from the second fluidic channel 22 and to decouple the first airflow passage 34 from the second airflow passage 24, thus inhibiting airflow between the first and second airflow passages. Or, for example, first component 230 described with reference to FIGS. 3A-8B can be rotated from the second angle to the first angle relative to second component 220 to decouple the first fluidic channel(s) 343 from the second fluidic channel(s) 543 and to decouple the first airflow passage 234 from the second airflow passage 224, thus inhibiting airflow between the first and second airflow passages. Such optional decoupling of fluidic channels may inhibit fluidic communication, e.g., direct or indirect contact, between aerosol-generating substrate, which may be in a reservoir, and an aerosol-generating element, such as a heater.

Optionally, the first component (e.g., 30 or 230) further comprises a first air inlet (e.g., 35 or 235) and a first air outlet (e.g., 36 or 236), the first airflow passage (e.g., 34 or 234) extending therebetween. Additionally, the first component may include a reservoir (e.g., 33 or 233) holding an aerosol-generating substrate, the first fluidic channel (e.g., 37 or 343) being coupled to the reservoir. Optionally, the second component (e.g., 20 or 220) further comprises a second air inlet (e.g., 25 or 325, 326, or 337) and a second air outlet (e.g., 26 or 536) the second airflow passage (e.g., 24 or 224) extending therebetween. Additionally, the second component may include an aerosol-generating element (e.g., 23 or 333) coupled to the second fluidic channel. Optionally, rotating, via the joint, the first component and the second component from the first angle to the second angle relative to one another couples the second air outlet to the first air inlet so as to form an extended airflow passage between the second air inlet and the first air outlet, and couples the first fluidic channel to the second fluidic channel such that the aerosol-generating substrate from the reservoir can be in fluidic communication, e.g., direct or indirect contact, with the aerosol-generating element via the first and second fluidic channels to generate an aerosol which is transmitted into the extended airflow passage. Optionally, rotating, via the joint, the first component and the second component from the second angle to the first angle relative to one another decouples the second air outlet from the first air inlet so as to inhibit airflow between the second air inlet and the first air outlet, and decouples the first fluidic channel from the second fluidic channel so as to inhibit fluidic communication, e.g., direct or indirect contact, between the aerosol-generating element and the reservoir.

Exemplary configurations including such options are provided with reference to FIGS. 1A-1B, 2A-2B, and 3A-8B.

Optionally, the aerosol-generating element (e.g., 23 or 333) comprises a heating element. The heating element optionally can be liquid-permeable. Additionally, or alternatively, the heating element optionally comprises a mesh. The mesh optionally is formed from wire having a diameter between about 10 μm and 100 μm.

Additionally, or alternatively, optionally the aerosol-generating substrate comprises nicotine.

Additionally, or alternatively, optionally the first component comprises a mouthpiece (e.g., end of component 30 including air outlet 36, or mouthpiece lid 239).

Additionally, or alternatively, optionally the second component comprises an internal housing (e.g., 237) holding the aerosol-generating element.

Additionally, or alternatively, the second component optionally further comprises a chamber, one side of the aerosol-generating element (e.g., 333) being in fluidic communication, e.g., direct or indirect contact, with the second fluidic channel (e.g., 543) and an opposite side of the aerosol-generating element being in fluidic communication, e.g., direct or indirect contact, with the chamber (e.g., space immediately above 333). Optionally, the second component further comprises a gas-permeable element (e.g., 334). Optionally, one side of the gas-permeable element is in fluidic communication, e.g., direct or indirect contact, with the chamber and an opposite side of the gas-permeable element is in fluidic communication, e.g., direct or indirect contact, with the second airflow passage. Optionally, the internal housing further comprises a lid (e.g., 335), the gas-permeable element being disposed between the lid and the aerosol-generating element.

Additionally, or alternatively, the first angle optionally is about 180° from the second angle.

Additionally, or alternatively, a device portion (e.g., 10 or 210) is provided comprising a power supply (e.g., 12) and control circuitry (e.g., 13) connected to the power supply, the device porting being coupled to the second component (e.g., via connections 251, 252) to allow for a supply of power from the power supply to the aerosol-generating element.

In the examples described, it should be clear that the reservoir and the aerosol-generating element respectively can be located in any suitable portion or portions of the system. For example, both the reservoir and the aerosol-generating element can be located in a first component of the system, and a second component of the system can comprise one or more fluidic passageways and one or more airflow channels. Rotation of the first component relative to the second component via a joint can fluidically couple the reservoir to the aerosol-generating element via the one or more fluidic passageways, such that aerosol-generating substrate within the reservoir can be in fluidic communication with the aerosol-generating element for being aerosolized. Additionally, such rotation of the first component relative to the second component can fluidically couple the aerosol-generating element to an airflow passage via which aerosolized aerosol-generating substrate can pass to the mouth of the user. It should also be clear that the shape and size of the airflow channel and in particular the atomisation chamber may be altered to provide for particular, desired properties of the aerosol delivered to the user.

It should be clear that, although certain of the examples described use a liquid aerosol-forming substrate, the provision of a gas-permeable element is beneficial in systems that use other forms of aerosol-forming substrate. An aerosol-forming substrate that is a solid or a gel at room temperature, may still release volatile components that condense into a liquid form in the atomising chamber. For example, the aerosol-forming substrate may be provided as a gel tablet. The aerosol-forming substrate may comprise particulate or cut tobacco.

It should also be clear that, although the examples describe the use of a resistive heating element to form an aerosol, the provision of a rotatable joint is beneficial in systems that operate using different kinds of heating element, such as an inductively heated heating element. The heating element need not be a fluid permeable heating element positioned between the aerosol-forming substrate and the extended airflow passage. The heating element may be an oven heater that heats the walls of the aerosol-forming substrate chamber to generate a vapour. The vapour may pass to the airflow passage through the heating element. The provision of a rotatable joint further may be beneficial for systems that form an aerosol by means other than heating.

The invention claimed is:

1. A system, comprising:

a first component comprising a first fluidic channel, a first airflow passage, and a reservoir holding an aerosol-generating substrate, the first fluidic channel being fluidically coupled to the reservoir;

a second component comprising a second fluidic channel and a second airflow passage;

a joint rotatably coupling the first component to the second component, wherein rotation, via the joint, of the first component and the second component from a first angle to a second angle relative to one another couples the first fluidic channel to the second fluidic channel and couples the first airflow passage to the second airflow passage; and a breakable member coupled to the first component and the second component, wherein the rotation of the first component and the second component relative to one another breaks the breakable member.

2. The system according to claim 1, wherein:

the first component further comprises a first air inlet and a first air outlet, the first airflow passage extending therebetween, the second component further comprises a second air inlet and a second air outlet, the second airflow passage extending therebetween, and an aerosol-generating element coupled to the second fluidic channel, coupling of the first fluidic channel to the second fluidic channel couples the second air outlet to the first air inlet so as to form an extended airflow passage between the second air inlet and the first air outlet, and coupling of the first fluidic channel to the second fluidic channel allows the aerosol-generating substrate from the reservoir to be in fluidic communication with the aerosol-generating element via the first and the second fluidic channels to generate an aerosol, which is transmitted into the extended airflow passage.

3. The system according to claim 2, wherein rotation, via the joint, of the first component and the second component from the second angle to the first angle relative to one another:

decouples the second air outlet from the first air inlet so as to inhibit airflow between the second air inlet and the first air outlet, and decouples the first fluidic channel from the second fluidic channel so as to inhibit fluidic communication between the aerosol-generating element and the reservoir.

4. The system according to claim 2, wherein the aerosol-generating element comprises a heating element.

5. The system according to claim 4, wherein the heating element is liquid-permeable.

6. The system according to claim 2, wherein the aerosol-generating substrate comprises nicotine.

7. The system according to claim 2, wherein the second component comprises an internal housing holding the aerosol-generating element.

8. The system according to claim 2, wherein the second component further comprises a chamber, one side of the aerosol-generating element being in fluidic communication with the second fluidic channel and an opposite side of the aerosol-generating element being in fluidic communication with the chamber.

9. The system according to claim 8, wherein the second component further comprises a gas-permeable element.

10. The system according to claim 9, wherein one side of the gas-permeable element is in fluidic communication with the chamber and an opposite side of the gas-permeable element is in fluidic communication with the second airflow passage.

11. The system according to claim 10, wherein the internal housing further comprises a lid, the gas-permeable element being disposed between the lid and the aerosol-generating element.

12. The system according to claim 1, wherein the first angle is about 180° from the second angle.

13. The system according to claim 1, further comprising a device portion comprising a power supply and control circuitry connected to the power supply, the device portion being coupled to the second component.

14. A method, comprising:

providing a first component comprising a first fluidic channel, a first airflow passage, and a reservoir holding an aerosol-generating substrate, the first fluidic channel being fluidically coupled to the reservoir;

providing a second component comprising a second fluidic channel and a second airflow passage;

providing a breakable member coupled to the first component and the second component;

providing a joint rotatably coupling the first component to the second component; and rotating, via the joint, the first component and the second component from a first angle to a second angle relative to one another so as to break the breakable member, to couple the first fluidic channel to the second fluidic channel, and to couple the first airflow passage to the second airflow passage.

* * * * *